United States Patent [19]

Otto

[11] Patent Number: 4,555,107

[45] Date of Patent: Nov. 26, 1985

[54] UNEVEN BARS

[76] Inventor: Lance M. Otto, 309 South Rd., Mile End, South Australia, Australia

[21] Appl. No.: 531,226

[22] Filed: Sep. 12, 1983

[30] Foreign Application Priority Data

Sep. 10, 1982 [AU] Australia ..... PF5842

[51] Int. Cl.[4] ..... A63B 3/00

[52] U.S. Cl. ..... 272/63; 272/DIG. 4

[58] Field of Search ..... 272/61, 62, 63, 109

[56] References Cited

U.S. PATENT DOCUMENTS 3,232,609 2/1966 Nissen et al. ..... 272/63

4,334,675 6/1982 Parry et al. ..... 272/63

*Primary Examiner*—Richard J. Apley

*Assistant Examiner*—James Prizant

*Attorney, Agent, or Firm*—Henry Sternberg; Bert J. Lewen

[57] ABSTRACT

Gymnastic apparatus of the type known as "uneven or asymmetric" bars having two working bars which are parallel to each other but of uneven height wherein the pairs of corresponding ends of the working bars are coupled together by link rods or bars which are preferably telescopic, each of the link rods or bars incorporating length adjustment means operable to effect length adjustment of the link bar and in turn adjustment of the spacing or width between the working bars.

6 Claims, 5 Drawing Figures

UNEVEN BARS

This invention relates to gymnastic apparatus which is known in the art as "uneven or asymmetric bars", that is, two bars which are parallel to each other but of uneven height.

Such gymnastic apparatus is used in international competition, largely by female gymnasts, and except for unevenness of height, it is somewhat similar to the so-called "parallel bars". Certain rules apply for standard construction, and these include the following:

(a) The apparatus must be constructed in such a way that, once set up, it has a pre-tension. It must be possible to adjust this pre-tension differently according to the wishes of the gymnasts, as gymnasts of lower weight generally want a softer adjustment of the bars, but gymnasts with higher weight prefer a harder adjustment.

(b) Changing the adjustment of tension must be so easy and without vigour, that it can be made from gymnast to gymnast quickly and simply even during competition.

(c) The length of the bars from pivot to pivot is 2400 mm with a tolerance of +5 mm.

(d) It must be possible to adjust both bars in height from the prescribed measurements of 1500 mm and 2300 mm +100 mm in steps of 50 mm each.

(e) The width of the bars must be easily adjustable. 25. The adjustment mechanism for the distance between the bars must be so constructed as not to interfere with the performance area, that it cannot loosen by itself or hinder the gymnast.

The present invention essentially concerns aspect (e) above and is aimed at providing an arrangement which will (a) enable the bar spacing to be quickly and easily adjusted and (b) allow the spacing between the bars to be set and measured with extreme accuracy. Of the prior art arrangements known to the applicant, whilst they generally satisfy feature (a), none however are considered to satisfy feature (b), that is, they do not enable one to readily and accurately measure the width between centres of the work bars.

In the main, prior art uneven bars comprised a pair of parallel spaced apart working bars or rails, each supported by a pair of uprights or posts, each of which incorporates a slidable extension to which the bar is attached to provide height adjustment means for the bar, and a pair of width adjustment mechanisms comprising, for example, a pair of threaded shafts one at each end of the apparatus, respectively interconnecting aligned front and rear uprights (posts). The width adjustment mechanisms are located below the level of the bars and are connected to the "fixed" uprights. Such an arrangement, although acceptable, does not allow one to quickly and easily, and with accuracy, set or measure the between centres width or spacing of the bars, since the measurement being considered is the horizontal spacing between the front and rear posts, not the actual centre-to-centre distance between the work bars.

Another prior art arrangement employs a cantilever design which has only two uprights or posts, one of the bars (the "high" bar) being secured to and extending between the posts, the other "low" bar being supported by and extending between a pair of cantilevered supports carried by the posts intermediate their ends, this being effective when in use, to return all of the exerted force on the low bar to the uprights where the support strength is centred. The width adjustment of the bars in this case is achieved by varying the heights of the bars with respect to one another. Thus, in this instance, it is done without an actual centre-to-centre measurement being made.

The main object of this invention is to provide improvements in uneven bars whereby the aforementioned desiderata may be efficiently and safely achieved without high cost.

Broadly according to this invention, there is provided a pair of link bars, one at each end of the apparatus, each link bar extending between and being pivotally connected with respect to a pair of post extensions, and being adjustable for length. This provides means which have been hitherto overlooked, for controlling the distance between the bars, which it is believed to be very important for different gymnasts, and for measuring accurately the width between centres of the working bars. It avoids the possibility of mal-adjustment of the bars which may make a gymnast's task more difficult.

More specifically according to this invention, gymnastic apparatus of the type known as "uneven or asymmetric" bars comprises a support base, four uprights or posts supported by the support base and arranged in a rectangular configuration, each post having a slidable post extension extending upwardly therefrom so as to provide bar height adjustment means, and a pair of spaced longitudinally extending parallel working bars supported by the uprights, the ends of each bar being coupled to respective mounting means carried by the upper free ends of said post extensions, characterised by a pair of link bars extending between respective laterally aligned pairs of said uprights or posts, pivot attachment means pivotally connecting each end of each link bar to a respective said post extension, each link bar incorporating length adjustment means operable to effect length adjustment of said link bar and in turn adjustment of the spacing or width between the working bars.

The inventor herein is unaware of any attempt ever having been made to achieve the width adjustment between the working bars through the use of adjustable link bars extending between pairs of corresponding ends of the working bars. The advantages of the applicant's system should be immediately apparent.

In order to ensure that there is no likelihood of the working bars becoming dislodged, especially during use, in a preferred embodiment of this invention, the frame is provided with upstanding posts from which respective post extensions extend upwardly, and at the upper end of each post extension there is provided a bar support member which is rotatable with respect to the post extension and has a slot therein for receiving a retaining pin on the end of a working bar, dislodgement of the retaining pin being inhibited by an upwardly extending plate on the post extension, the upwardly extending plate supporting one end of a link bar.

In order to more fully explain the present invention, an embodiment is described hereunder in some further detail with reference to the accompanying drawings in which:

FIG. 2*a* is a front elevational view of the bar holder according to the present invention, FIG. 2*b* is a side elevational view of the bar holder of FIG. 2*a*.

Figure 1:
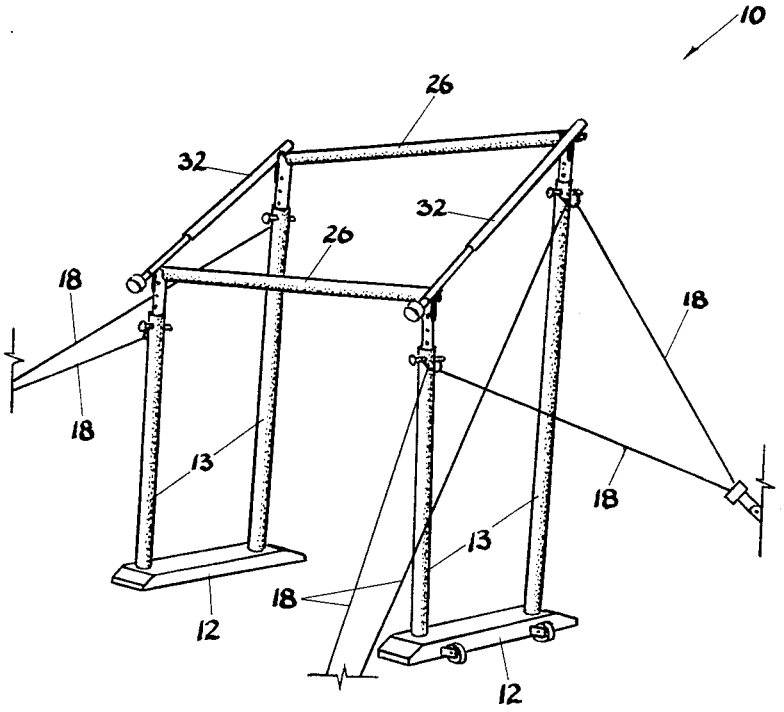
FIG. 1 is a perspective view of the apparatus of this invention.
Figure 2:
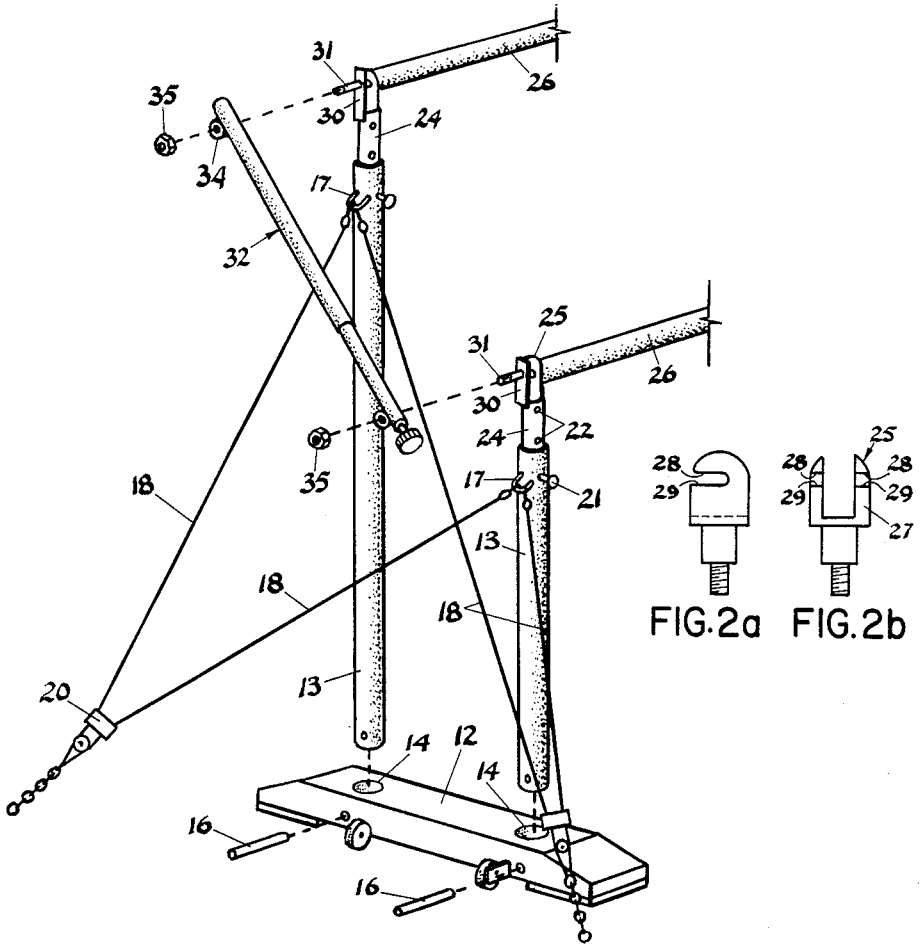
FIG. 2 is a fragmentary exploded perspective view of the apparatus of FIG. 1.
Figure 3:
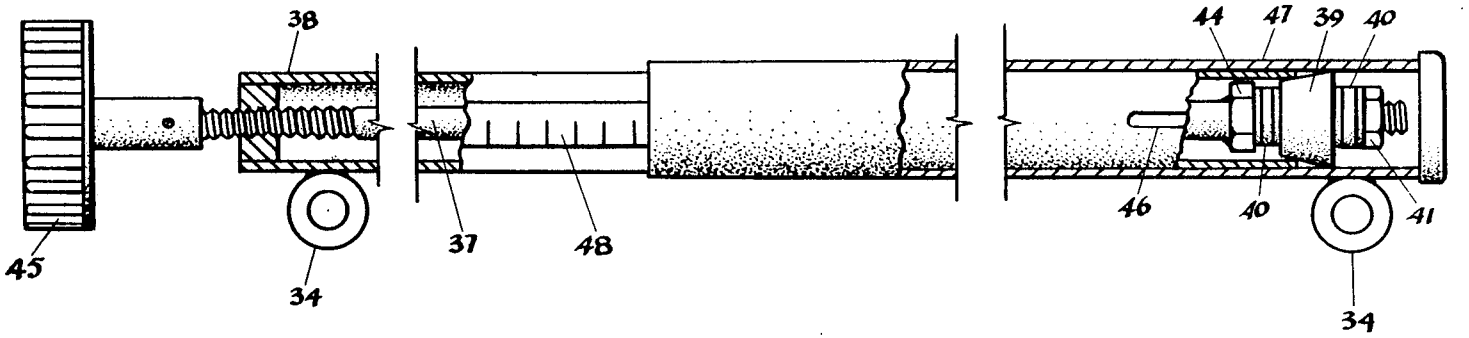
FIG. 3 is a partly sectioned plan view of one of the adjustable link rods or bars.

In this embodiment, apparatus 10 comprises a support base 11 which itself comprises a pair of longitudinally spaced transverse base footings 12, each of which has two tubular metal posts 13 upstanding therefrom. The posts 13 are arranged in a rectangular configuration, and each post 13 has its base end removably located in a socket 14 in the footing 12 by means of a removable pivot pin 16. Each tubular post 13 is provided with a link 17 secured to its upper end, and these links 17 support flexible guy cables 18 which are arranged to be attached to floor anchors through springs (not shown). The cables 18 however are provided with tensioning means which in this embodiment comprise sleeves 20 which are slidable over a pair of cable lengths which go to respective posts 13 at one end of the apparatus 10, so that the angle between the cables where they attach to the posts 13 can be increased and thereby tension the cables 18, simply by sliding the sleeve 20 over the cable. This arrangement is substantially in accord with prior art.

The upper end of each tubular post 13 is also provided with a spring-loaded plunger 21 having a projecting end which is arranged to project into one of a series of apertures 22 in the side wall of a post extension 24 which extends upwardly from its respective tubular post 13 in a telescopic manner. The apertures 22 are spaced in accordance with the aforementioned standards, that is, at 50 mm centres.

Each post extension 24 terminates in a bar holder 25 for supporting the parallel working bars 26, each bar holder 25 having a stem which is held captive within its post extension 24 against axial movement. Each bar holder 25 also comprises a swivellable bifurcate or forked head 27 which terminates at its upper end in a bullnose, such an arrangement also being in accordance with prior art. The swivel head 27 is formed with walls 28 which define a pair of open-ended slots 29 extending horizontally, and these slots 29 are engaged by outstanding ends of a pin (not shown) in the end of the working bar 26. Each post extension 24 itself has welded thereto an upwardly extending plate 30 which is contiguous with its associated swivel head 27, the arrangement being such that when the working bar 26 is in its correct position, the upwardly extending plate 30 closes the open ends of the slots 29 thereby inhibiting unintentional release of the working bar 26 when it is in its engaged position.

The upwardly extending plate 30 on each of the post extensions 24 has an outwardly extending swivel or pivot pin 31 which, preferably, is approximately co-axially aligned with the working bar 26, the pin 31 providing pivotal support for one end of a telescopic link bar 32 through an apertured collar or sleeve 34 welded to the underside of the link bar 32 at or adjacent that one end. The other end of the link bar 32 is similarly swivellably or pivotally mounted to the upper end of the post extension 24 on the other side of the apparatus 10. Nuts 35 are threaded onto the pins 31 and lock the link bars 26 in position.

Each telescopic link bar 32 is provided with a threaded rod 37 which extends into the inner telescopic member 38 and terminates at its inner end in a frustoconical sleeve or wedge 39 carried between a pair of thrust washers 40, themselves retained in position by a lock nut 41. The threaded rod 37 also passes through a fixed nut 44 at the mouth end of the inner member 38, and terminates at its outer end in a tightening handle 45. The inner end of the inner tubular member 38 is provided with a plurality of axially extending slits 46 so that the member 38 can spread as the rod 37 is tightened in the nut 41 to draw the circular wedge 39 into the open inner end of the tubular member 38.

The outer large diameter telescopic member 47 contains the inner member 38 normally for sliding movement, but when the circular wedge 39 is tightened, of course the two members 38, 47 become locked together. The outer tube 47 is also carried on the post extension 24 in the same way as the inner tube 38.

In order to ascertain the length of the telescopic link bar 32 (deemed by the inventor herein to be of major importance) a graduated scale 48 is secured to the inner tubular member 38 on its outer face and this is read at the point where it enters the mouth of the outer tubular member 47. This arrangement thus allows the distance between the centres of the bars 26 to be quickly and accurately measured.

It should of course be appreciated that the length adjustment mechanism for the link bars may take different forms, and could, for example, comprise a turnbuckle arrangement, or a locking element which lockingly engages a grooved surface of a rack member; however, these and other variations will be seen to lie within the scope and spirit of this invention.

A consideration of the above embodiment will indicate that the invention provides very simple and inexpensive means whereby the width between the working bars can be readily ascertained and secured, and provides an additional advantage in that it removes most of the hazards otherwise encountered.

I claim:

1. Gymnastic apparatus of the type known as "uneven or asymmetric" bars comprising support means, four uprights supported by said support means and arranged in a rectangular configuration, each upright having a slidable post extension extending upwardly therefrom so as to provide bar height adjustment means, and a pair of spaced longitudinally extending parallel working bars supported by the uprights, the ends of each working bar being coupled to respective mounting means carried by the upper free ends of said post extensions, characterised by:

a pair of link bars extending between respective laterally aligned pairs of said uprights, pivot attachment means pivotally connecting each end of each said link bar to a respective one of said post extensions in proximity to the axis of the corresponding one of said working bars, each link bar comprising length adjustment means operable to effect length adjustment of said link bar and in turn adjustment of the spacing or width between the working bars.

2. Apparatus according to claim 1 wherein said link bar is hollow and said length adjustment means is housed interiorly thereof.

3. Apparatus according to claim 2 wherein said link bar is telescopic and comprises inner and outer telescopic tubular members, and said adjustment means comprises a threaded rod extending into said inner telescopic member and carrying an operating handle or knob at its outer end, and locking means carried on the threaded rod for releasably locking the inner and outer telescopic members against axial movement, arranged so that, with the locking means released rotation of the operating knob or handle and therefore the rod effects relative axial movement of the telescopic inner and outer tubular members.

4. Apparatus according to claim 3 wherein said pivot attachment means comprises a sleeve or collar secured at or adjacent to each axial end of the telescopic link bar and a horizontal stud or pin secured with respect to the upper end of a respective said post extension and projecting outwardly therefrom, the studs or pins constituting pivot supports for respective said sleeves or collars on the link bar.

5. Apparatus according to claim 4 further comprising retention nuts threadably engaging respective pins to thereby lock the sleeve or collars against axial displacement.

6. Apparatus according to claim 1 further comprising a working bar holder rotatable with respect to a respective said post extension and having a slot therein for receiving a retaining pin carried at the end of a respective said working bar, dislodgement of the retaining pin being inhibited by an upwardly extending plate secured to the upper end of the post extension, said upwardly extending plate pivotally supporting one end of a respective said link bar.

* * * * *